US006015287A

United States Patent [19]

Berlaimont et al.

[11] Patent Number: 6,015,287

[45] Date of Patent: Jan. 18, 2000

[54] LIQUID HYDROCARBON BURNER

[75] Inventors: Claude Berlaimont, Falisolle; Raymond Champion, Couvin, both of Belgium

[73] Assignee: Thermic Investment, Luxembourg, Luxembourg

[21] Appl. No.: 08/784,133

[22] Filed: Jan. 15, 1997

[30] Foreign Application Priority Data

Jan. 18, 1996 [BE] Belgium ..... 09600044

[51] Int. Cl.[7] ..... F23D 5/02

[52] U.S. Cl. ..... 431/338; 431/339; 431/342

[58] Field of Search ..... 431/331, 338, 431/339, 342

[56] References Cited

U.S. PATENT DOCUMENTS 3,199,569 8/1965 Rozsnyo ..... 431/338
4,616,993 10/1986 Hikino et al. ..... 431/331

FOREIGN PATENT DOCUMENTS 2308054 11/1976 France ..... 431/338

*Primary Examiner*—Carroll B. Dority
*Attorney, Agent, or Firm*—Venable; George H. Spencer; Ashley J. Wells

[57] ABSTRACT

A liquid hydrocarbon burner includes a single-walled pot; and a catalytic element placed centrally in the single-walled pot and comprised of an assembly of blades which are arranged concentrically around a vertical axis, which have in axial cross-section a mushroom shape, and which blades have respective upper parts and lower parts with respective weights such that the weight of the lower parts is greater than that of the upper parts. A process for preparing a sheet of chromium inox steel which is catalytically active for hydrocarbon combustion so that it is suitable for making blades for a catalytic element of a liquid hydrocarbon burner includes providing a sheet of chromium inox steel having a silicon content which exceeds 0.40%±0.05 so that the chromium inox steel is refractory to the core; and pickling the sheet of chromium inox steel by treatment thereof with an acid effective to pickle chromium inox steel and render at least the surface thereof catalytically active for hydrocarbon combustion.

11 Claims, 2 Drawing Sheets

LIQUID HYDROCARBON BURNER

BACKGROUND OF THE INVENTION

1. Field of the Invention

The present invention relates to a liquid hydrocarbon burner composed of a single-walled pot.

2. Description of the Related Art

In order to burn a liquid hydrocarbon hygienically in a burner of the considered type, this hydrocarbon has to be gasified and mixed in appropriate amounts with an oxidant, in this case oxygen from the air. The liquid hydrocarbon evaporates upon coming into contact with the sheet metal forming the bottom of the pot of the burner.

This sheet metal has to be sufficiently hot in order to quickly evaporate the fraction of the liquid hydrocarbon which distills at the highest temperature.

In case of commercial fuel-oil, this temperature is on the order of 370° C. The "petroleum's" distill at lower temperatures, the oils, in particular agricultural fuel oils, generally distill at higher temperature.

If the most refractory fuel component is not evaporated, the pot whose bottom forms the evaporation plate becomes engorged, and if the evaporation takes too long a time, the fuel polymerizes into a compact black agglomerate.

If the temperature is too high (on the order of 550° C. for the fuel-oil), a pyrolysis will occur which will break down the hydrocarbon molecules into a flocking of powdery black dirt, i.e., soot. This pyrolysis has to take place in the pot of the burner in the presence of a turbulence with an average raising speed which is sufficient to prevent such deposits.

An object of the invention is therefore to create optimal combustion conditions, both from the point of view of heating efficiency and from the "hygienic" point of view.

SUMMARY OF THE INVENTION

In order to realize this objective in accordance with the invention, the liquid hydrocarbon burner according to the invention is characterized by the presence of a catalytic element which is placed centrally in the pot.

Still according to the invention, said catalytic element is composed of nickel-free inox steel pertaining to the group of ferritic chromium steels which are refractory to the core.

In its preferred embodiment, the catalytic element is composed of an assembly of blades arranged concentrically around an axis situated, in the use position, in the center of the pot of the burner and the assembly of said blades has, in a cross-section according to said axis, the shape of a mushroom.

A remarkable characteristic of the invention consists in the fact that each of said blades is made in such a manner that in the use position the upper part of the catalytic element is reduced in weight whilst the lower part is made heavier and that each of said blades comprises, still in the use position, a rounded upper part substantially in the shape of a quarter of a circle and a lower part with larger charge losses extending substantially vertically towards the bottom of the pot of the burner, the parts with larger charge losses showing openings for the flow of oxidant air.

Other details and advantages of the invention will become apparent from the description which will be given hereinafter of a liquid hydrocarbon burner according to the invention. The reference numerals relate to the figures annexed hereto.

DESCRIPTION OF THE PREFERRED EMBODIMENTS

Figure 1:
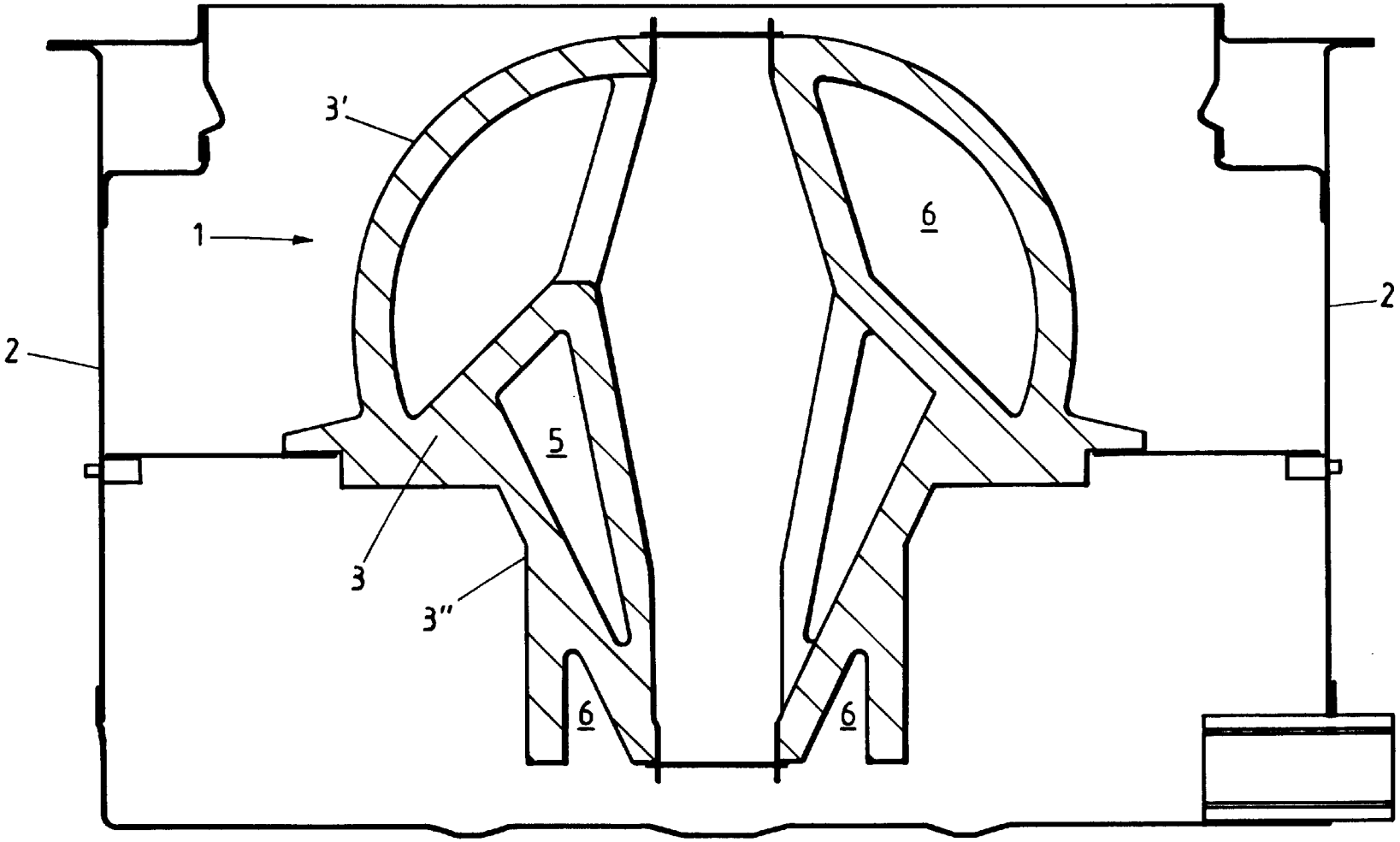
FIG. 1 is a schematic elevational view of a single-walled oil-fired burner equipped with a catalytic element according to the invention.

The catalytic element 1, 1' shown in these figures is destined to equip the pot 2 of a single-walled oil-fired burner. It is made in the form of an assembly of star-wise arranged blades 3, 4. The blades 3, 4 are joined at their top with a disc 7 which forms an obstacle for the flow of hot air.

According to a first embodiment, the blades 3, 4 are made from inox (stainless) steel without nickel pertaining to the ferritic chromium steels which are refractory to the core due to a silicon content higher than 0.40 to 0.50. It is also possible to make use of titanium stabilized steel chromized in a later phase.

The catalyst element can alternatively be composed of a refractory material for solid fuels rendered catalytic by a chromium or zirconium treatment, or an opaque support which imitates a solid fuel and incorporates a catalyst, such as inox 430 particles, or a low expansion composite glass, any of the foregoing being rendered catalytic by treatment with or the presence of chromium, zirconium, or inox 430 (stainless steel).

The catalytic element shown in the different figures in two embodiments is composed of an assembly of blades 3, 4 showing a rounded upper part 3', 4'. The weight of the upper part of the assembly of the blades is lower than the weight of the lower part 3", 4" of the same assembly of blades.

Figure 3:
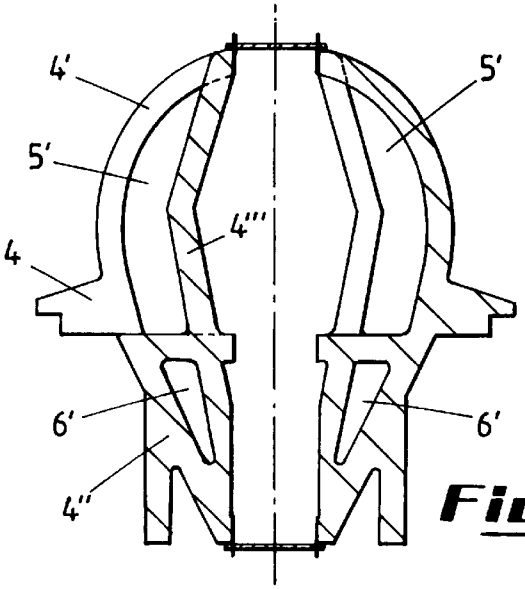
FIG. 3 is, on another scale, a partially cross-sectional and partially elevational view of a variant of the catalytic element according to the invention.
Figure 4:
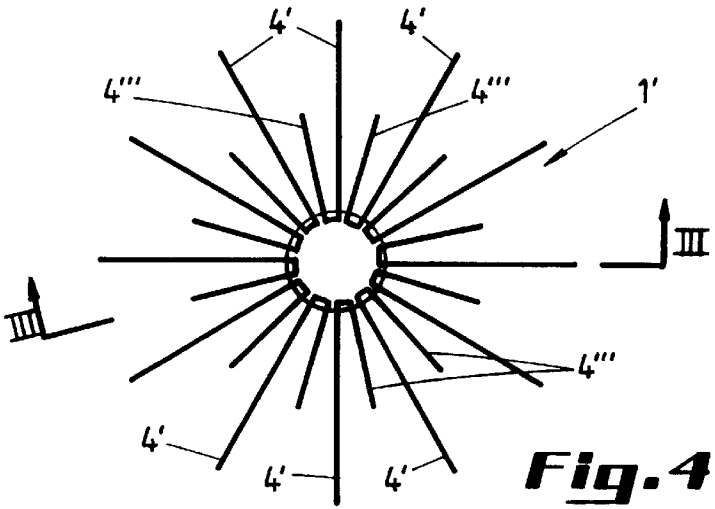
FIG. 4 is a schematic elevational view of the catalytic element according to FIG. 3.
Figure 2:
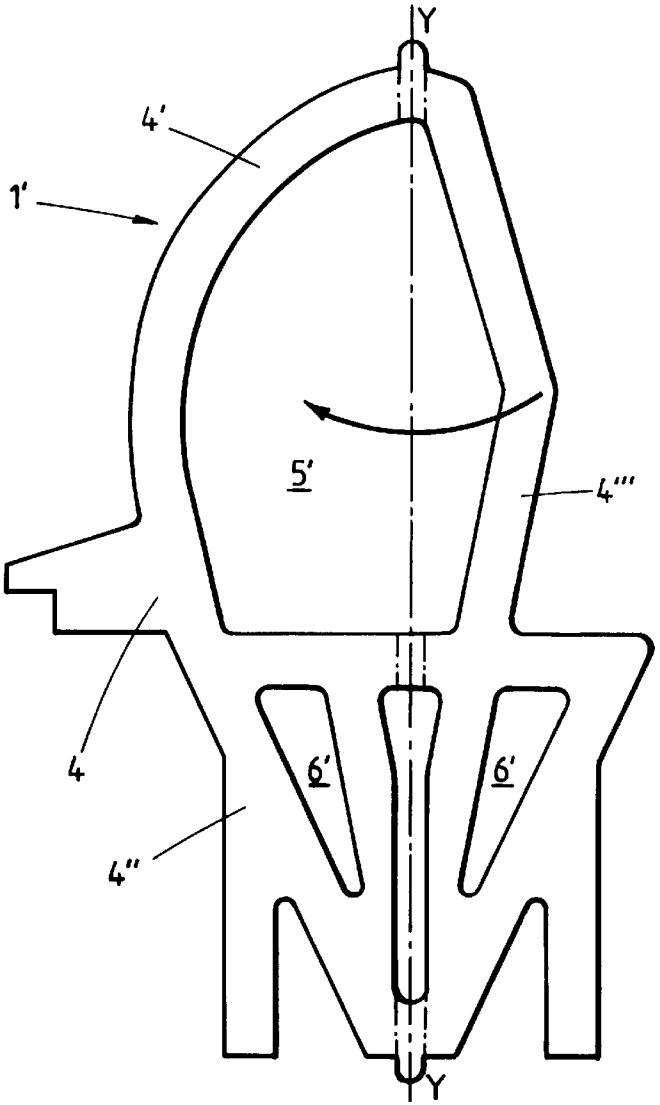
FIG. 2 is an elevational view of a constitutive blade of the catalytic element according to the invention.

The blades 3 are of the type mainly shown in FIG. 1 whereas the blades 4 pertain to the type of catalytic element shown in FIGS. 2–4. In the two blade types, the upper part 3', 4' thereof is rounded in the form of a circle bow extending over about 90° whereas the lower part 3", 4" extends, in the use position, vertically or under a slight angle towards the bottom.

In the blades there are provided more or less large openings or holes permitting a flow of air. In the blades shown in FIG. 1, these openings are indicated with references 5 and 6.

In FIGS. 2 and 3, these openings are indicated with references 5' and 6'. Referring to FIGS. 2, 3 and 4, one will notice that composite blades composed of a curved blade 4' with a larger radius and a curved blade 4"' shown in the form of a broken line (bent angled linear portion), are obtained by folding the blade 4"' and its lower part 4" along an axis Y—Y (FIG. 2). An assembly of blades of two different types as shown schematically in FIG. 4 is thus obtained.

After having described the structure of the catalytic element according to the invention in detail, it will be underlined that the presence of this element in the reaction heart, i.e., the center of the burner enables reduction of the critical combustion initiation temperature under the particular molar conditions prevailing at the surface of the catalytic element.

A catalytic element formed of steel with 16–17% chromium meets these conditions due to the presence of iron pentacarbonyl and chromium carbonyl $Cr(CO)_6$ appearing after a certain operation time.

In certain cases, however, metallurgical impurities present in the steel partially inhibit the catalysis. It is admitted that this must be due to the silicon, the presence of which lowers the oxidation speed of the stainless steel (inox 430) at temperatures higher than 400° C. A silicon concentration lower than 0.25% will result in too quick a destruction of the catalytic element whereas a silicon concentration higher than 0.35% prevents the formation of an oxide layer to which the iron pentacarbonyl and chromium carbonyl catalysts adhere.

Hence, the invention also relates to a process for treating a sheet of chromium inox steel which is refractory to the core, according to which the sheet is pickled in advance by means of an acid, such as hydrochloric, sulfuric or hydrofluoric acid. The pickling treatment is continued until the stainless steel sheet has achieved the expected catalytic properties on the surface.

The invention is not limited to the described embodiments but it is possible to apply modifications thereto provided they fall within the scope of the appended claims.

What is claimed is:

1. A liquid hydrocarbon burner, comprising:

a single-walled pot; and a catalytic element placed centrally in the single-walled pot and comprised of an assembly of blades which are arranged concentrically around a vertical axis, which have in axial cross-section a mushroom shape, and which blades have respective upper parts and lower parts with respective weights such that the weight of the lower parts is greater than that of the upper parts.

2. The liquid hydrocarbon burner as claimed in claim 1, wherein the single-walled pot has a central vertical axis, and wherein the vertical axis around which the assembly of blades is concentrically arranged is coincident with the central vertical axis of the single-walled pot.

3. The liquid hydrocarbon burner as claimed in claim 1, wherein the upper part of each respective blade is rounded and has a shape which is substantially a quarter of a circle, and wherein the lower part of each respective blade extends substantially vertically toward the bottom of the single-walled pot, has defined therein at least one opening allowing for a flow of oxidant air there through in use, and has a larger charge loss in use.

4. The liquid hydrocarbon burner as claimed in claim 1, wherein the blades of the assembly of blades are joined at respective tops of the upper parts thereof by a disc which forms an obstacle for the flow of hot air there through in use.

5. The liquid hydrocarbon burner as claimed in claim 1, wherein the liquid hydrocarbon has a critical combustion initiation temperature, wherein the catalytic element is comprised of a material including iron and chromium, and wherein at least a portion of the iron and the chromium is transformed in use into respective carbonyl compounds which are catalytically active and which reduce the critical combustion temperature of the liquid hydrocarbon.

6. The liquid hydrocarbon burner as claimed in claim 1, wherein the catalytic element is composed of a ferritic chromium steel which is a nickel-free inox steel.

7. The liquid hydrocarbon burner as claimed in claim 1, wherein the catalytic element is composed of titanium stabilized steel which is chromized.

8. The liquid hydrocarbon burner as claimed in claim 1, wherein the catalytic element is composed of a refractory material and a catalytically active material selected from the group consisting of chromium and zirconium.

9. A liquid hydrocarbon burner, comprising:

a single-walled pot; and a catalytic element placed centrally in the single-walled pot and comprised of an assembly of blades which are arranged star-wise and concentrically around an axis, and which have respective upper parts and lower parts, the respective upper parts comprising a curved portion and a bent angled linear portion.

10. The liquid hydrocarbon burner as claimed in claim 9, wherein each respective blade has a longitudinal Y—Y axis, and wherein each respective blade is folded against itself along the longitudinal Y—Y axis so that the curved portion and the angled linear portion of each respective upper part face one another and are spaced apart from one another.

11. The liquid hydrocarbon burner as claimed in claim 9, wherein the curved portion of respective upper parts of respective blades is a circle segment extending over about 90°, and wherein at least a portion of respective lower parts of respective blades are angled.

* * * * *